US008595911B2

(12) United States Patent
Hendren et al.

(10) Patent No.: US 8,595,911 B2
(45) Date of Patent: Dec. 3, 2013

(54) EXTRACTION DEVICE FOR REMOVING A VEHICLE FASTENER

(75) Inventors: Jason Hendren, Milford, OH (US); Deron Payne, Pickerington, OH (US)

(73) Assignee: Honda Motor Co., Ltd., Tokyo (JP)

( * ) Notice: Subject to any disclaimer, the term of this patent is extended or adjusted under 35 U.S.C. 154(b) by 903 days.

(21) Appl. No.: 12/749,933

(22) Filed: Mar. 30, 2010

(65) Prior Publication Data

US 2011/0239433 A1 Oct. 6, 2011

(51) Int. Cl.
*B25B 27/14* (2006.01)

(52) U.S. Cl.
USPC ..... 29/426.5; 29/260; 29/266

(58) Field of Classification Search
USPC ..... 29/426.1, 260–261, 266, 741, 758, 764
See application file for complete search history.

(56) References Cited

U.S. PATENT DOCUMENTS

| | | | | |
|---|---|---|---|---|
| 1,141,742 | A | 6/1915 | Wiseman | |
| 2,277,587 | A | 3/1942 | Gustafson | |
| 2,870,536 | A * | 1/1959 | Lutsker | 30/102 |
| 3,125,370 | A * | 3/1964 | McGill | 294/115 |
| 3,735,650 | A | 5/1973 | Weng, Jr. | |
| 3,978,576 | A | 9/1976 | Mustoe, Jr. | |
| 4,886,635 | A * | 12/1989 | Forster et al. | 376/268 |
| 5,213,311 | A | 5/1993 | Sabo | |
| 5,516,173 | A * | 5/1996 | Sawdon | 294/86.4 |
| 5,611,519 | A | 3/1997 | Garcia | |
| 5,924,679 | A | 7/1999 | Wilson | |
| 5,975,605 | A * | 11/1999 | Kot | 294/115 |
| 6,412,375 | B1 | 7/2002 | Wang et al. | |
| 6,634,630 | B2 * | 10/2003 | Horn et al. | 269/34 |
| RE39,786 | E * | 8/2007 | Dellach | 403/322.3 |
| 8,297,673 | B2 * | 10/2012 | Waldorf et al. | 294/203 |
| 2002/0093211 | A1 * | 7/2002 | Filipiak et al. | 294/88 |
| 2006/0150786 | A1 | 7/2006 | Whitehead et al. | |
| 2008/0240882 | A1 | 10/2008 | Schwarzkopf | |

FOREIGN PATENT DOCUMENTS

| | | |
|---|---|---|
| CA | 2444426 | 4/2005 |
| SU | 1458197 | 2/1989 |

* cited by examiner

*Primary Examiner* — Minh Trinh
(74) *Attorney, Agent, or Firm* — Rankin Hill & Clark LLP

(57) ABSTRACT

An extraction device for removing a vehicle fastener includes a housing, a body, and cam members. The housing has a camming surface and the body is slidably connected to the housing. The cam members are rotatably connected to the body. Slidable movement of the body and the housing relative to one another causes engagement between the camming surface of the housing and the cam members to cause the cam members to rotate. This rotation of the cam members results in the vehicle fastener being unfastened.

20 Claims, 4 Drawing Sheets

EXTRACTION DEVICE FOR REMOVING A VEHICLE FASTENER

BACKGROUND

Exemplary embodiments herein relate to clip removal tools, and more particularly to an extraction device with cam members for removing a vehicle fastener (e.g., garnish push clips).

Push clips are used for a variety of fastening applications in the automotive industry and otherwise. For example, push clips may be used in vehicles to join components together. Many times, push clips are used to secure vehicle garnish trim pieces to the cabin interior structure or to attach fascia body parts, such as bumper covers or mud skirts, to the vehicle structural members.

Push clips can have a two-piece construction comprising a clip body and a pin. The pin has a head at one end and an enlarged tip at the other end, the head and the enlarged tip being connected by a shaft. The clip body, sometimes referred to as a dog house, can include an annular washer with an opening that leads to an expandable cavity that swells upon receipt of the enlarged tip of the pin in the cavity. In practice, the clip body is installed into a hole where fastening is required without the pin or with the pin being only partially inserted into the opening of the clip body. When fastening is desired, the pin is fully inserted into the clip body so that the enlarged tip of the pin is fully received within the cavity of the clip body. This causes the cavity of the clip body to expand and fastening then occurs. Some push clips comprise only a pin that is received through an aperture in another component (i.e., there is no clip body).

In either construction, when fastening is no longer desired, the pin is removed or extracted. When the clip includes a pin and a clip body, the pin can be removed or extracted from the clip body so that the cavity defined by the clip body can shrink in size, thereby easing removal of the clip body from the hole where fastening occurred. For this to occur, the head of the pin must be extracted from the clip body so that the tip of the pin is withdrawn from the cavity of the clip body.

Extraction of the head of the pin from the clip body can be difficult as the head of the pin may be nearly coplanar with the washer of the clip body. As garnish push clips are many times made of plastic or other more fragile or deformable materials, care must be taken during removal of the pin from the clip body to prevent damage to the push clip. Further, prying of the head of the push clip with a blunt or pointed object can result in damage to the push clip or surrounding areas and/or injury to the individual if the blunt or pointed object slips from the head of the pin.

BRIEF DESCRIPTION

According to one aspect, an extraction device for removing a vehicle fastener includes a housing having a camming surface, a body slidably connected to the housing, and cam members rotatably connected to the body. Slidable movement of the body and the housing relative to one another causes engagement between the camming surface and the cam members, thereby causing the cam members to rotate and unfasten the vehicle fastener.

According to another aspect, an extraction device for removing a vehicle fastener includes a housing with a camming surface at a first end of the housing, a body slidably received through the first end of the housing so that at least a portion of the body is within the housing, and cam members pivotably attached to the body. Lever ends of the cam members contact the camming surface of the housing so as to rotate respective extraction ends of the cam members to contact and unfasten the vehicle fastener.

According to still another aspect, a method of removing a fastener from a vehicle is provided. In the method, one of a body and a housing is slidably moved relative to the other of the body and the housing. The body has cam members rotatably connected thereto. A camming surface of the housing is engaged with the cam members. The cam members are rotated with the camming surface to unfasten the vehicle fastener when the camming surface engages the cam members. The body and the housing are slidably moved relative to one another.

DETAILED DESCRIPTION

Figure 1:
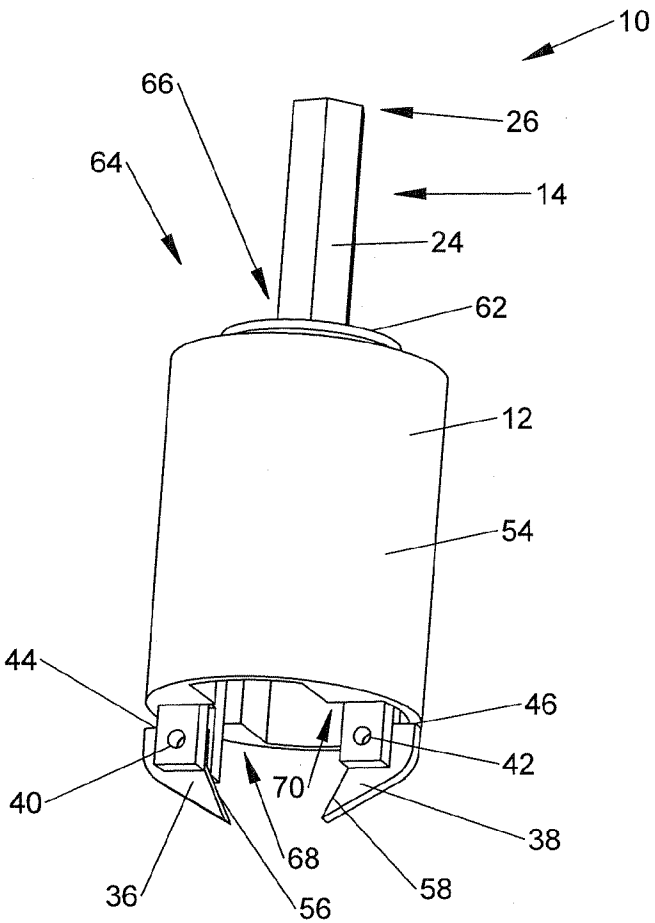
FIG. 1 is a perspective view of an extraction device having a body with rotatably connected cam members slidably received within a cylindrical housing.

Referring now to the drawings, wherein they are for purposes of illustrating one or more exemplary embodiments and not for purposes of limiting same, FIG. 1 illustrates a fastener extraction device 10 for removing a vehicle fastener. The extraction device 10 includes a housing 12 and a body 14 that is slidably connected and movable relative to the housing 12. As will be described in more detail below, the housing 12 has a camming surface (e.g., surfaces 48, 50) and the body 14 has cam members (e.g., cam members 36, 38) rotatably connected thereto. As will also be described in more detail below, slidable movement of the body 14 and the housing 12 relative to one another causes engagement between the camming surfaces 48, 50 and the cam members 36, 38, thereby causing the cam members 36, 38 to rotate and unfasten the vehicle fastener on which the extraction device 10 is used.

Figure 4:
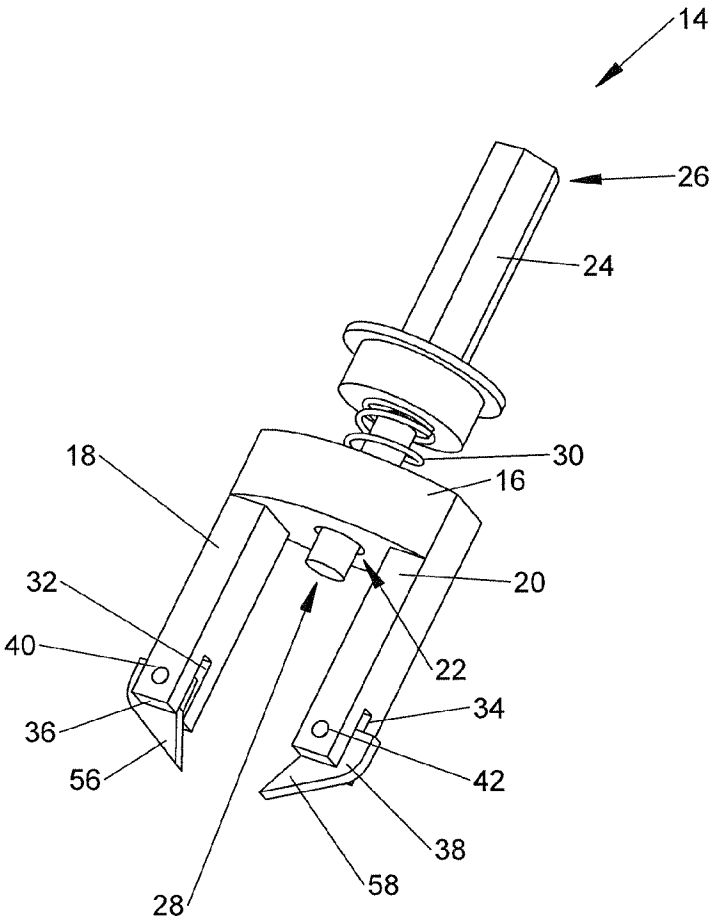
FIG. 4 is a perspective view of the body shown according to a second embodiment.
Figure 3:
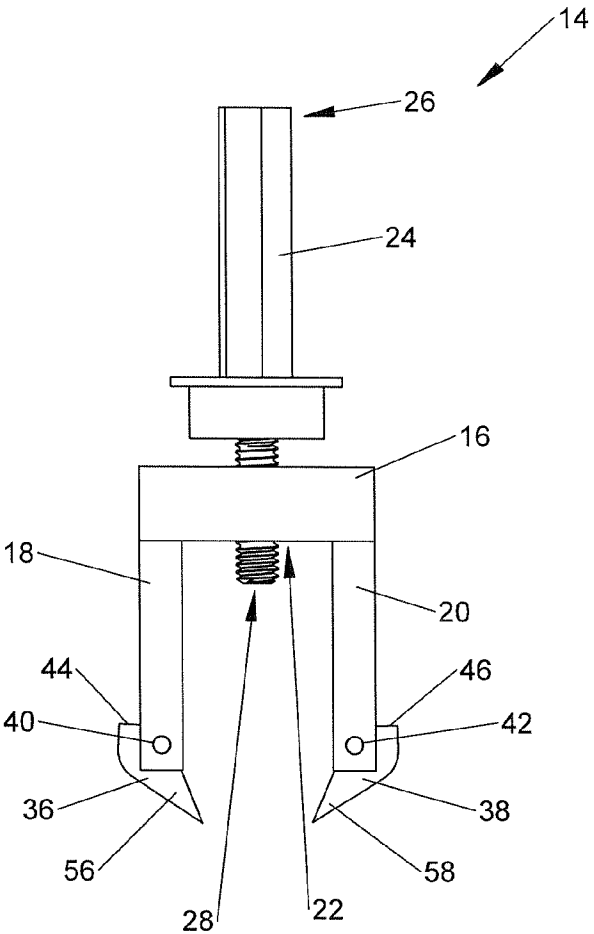
FIG. 3 is an elevational view of the body shown according to a first embodiment.

As shown in FIGS. 3-4, the body 14 can have a generally U-shaped configuration and can include a connecting member 16 with opposed arms 18, 20 that extend from the connecting member 16. The connecting member 16 may include an aperture 22 for passage of a handle 24. The handle 24 primarily extends from the connecting member 16 in a first direction and the opposed arms 18, 20 extend from the connecting member 16 in a second, opposite direction. The handle 24 has an operation end 26, which can be configured to cooperate with a rotary tool (e.g., a manual rotating tool or a powered rotary tool). For example, the handle 24 can have a polygonal cross-sectional shape (e.g., hexagonal) that can be cooperatively received in a matching recess of the rotary tool. The handle 24 also has an opposite, engagement end 28 for engaging or otherwise cooperating with the connecting member 16. A portion of the handle 24 is surrounded by a collar 62 that contacts a top cap 64 of the housing 12. The top cap 64 has an aperture 66 for receipt of the collar 62. As will be described in more detail below, the engagement end 28 of the handle 24 can be threadedly received in an aperture 22 of the body 14 in the embodiment of FIG. 3. In contrast, there is no threaded engagement between the engagement end 28 and the aperture 22 in the embodiment of FIG. 4, but a spring 30 is annularly disposed about the engagement end 28 of the handle 24 for purposes of which will become apparent upon reading the further description below. In both illustrated embodiments of FIGS. 3 and 4, each of the opposed arms 18, 20 can have a slot 32, 34 for receipt of the respective cam member 36, 38 that is rotatably retained by the respective pin 40, 42.

Figure 6:
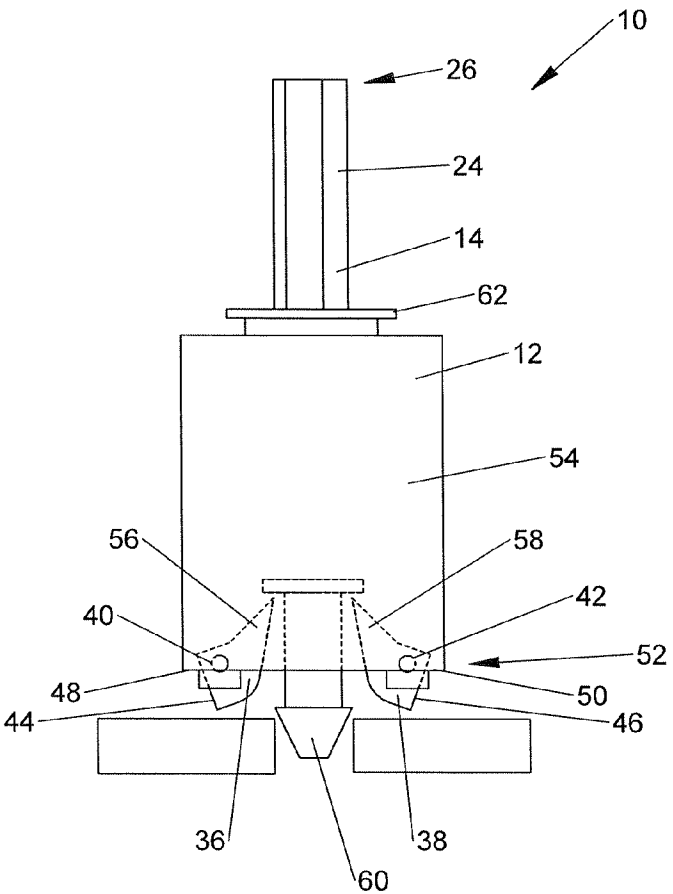
FIG. 6 is an elevational view of the extraction device shown just after removal of the vehicle fastener.
Figure 5:
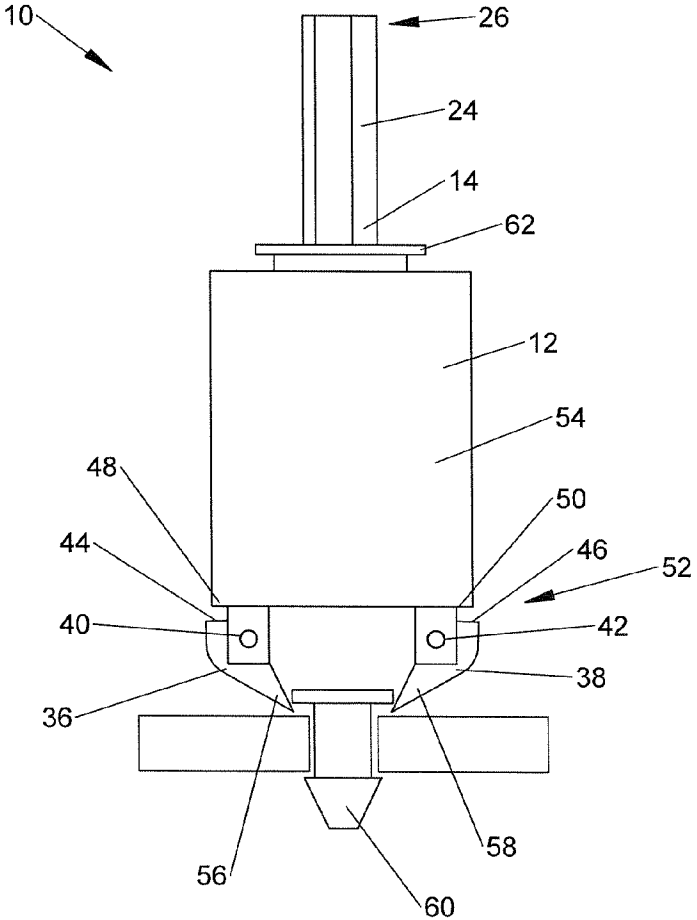
FIG. 5 is an elevational view of the extraction device shown just prior to removal of the vehicle fastener.

As shown, and with particular reference to FIGS. 5-6, each of the cam members 36, 38 has a lever end 44, 46 for contact with a respective camming surface 48, 50. The respective camming surface 48, 50 is located at a first end 52 of at least one sidewall 54 of the housing 12. Each of the cam members 36, 38 also includes an extraction end 56, 58 for contact with a fastener, such as the illustrated push clip 60.

The handle 24 includes the operation end 28 and the engagement end 26. The operation end 28 may be used by an operator or other mechanized devices to operate the extraction device 10 as described hereinabove. As shown, the operation end 28 has a polygonal cross-sectional shape to aid the operator or other mechanized device in grasping and actuating the extraction device 10. However, there may be circumstances where the operation end 28 will be round in cross-section.

As shown in the embodiment illustrated in FIG. 3, the engagement end 26 of the handle 24 is threaded. The threads at the engagement end 26 of the handle 24 are sized so as to engage the threads of the aperture 22 of the connecting member 16. The handle 24 rotates independently of the housing 12, but can be linearly linked. Depending on the direction of rotation of the handle 24, the body 14 will either retract or extend from the housing 12. Retraction of the body 14 at least partially into the housing 12 will result in the camming surfaces 48, 50 of the housing 12 rotating the cam members 36, 38 so that the extraction ends 56, 58 of the cam members 36, 38 will begin to point towards the connecting member 16 of the body 14. With reference to FIGS. 3 and 5-6, engagement of the cam member 36 by the camming surface 48 of the housing 12 will result in the cam member 36 rotating in a counterclockwise direction. Further, engagement of the cam member 38 by the camming surface 50 will result in the cam member 38 rotating in a clockwise direction.

As shown in an alternative embodiment illustrated in FIG. 4, the engagement end 26 of the handle 24 is smooth. Further, the aperture 22 in the connecting member 16 is also smooth and sized so as to allow the engagement end 26 of the handle 24 to at least partially and freely extend through the connecting member 16 of the body 14 without engagement. The spring 30 is coaxially disposed on the handle 24 between the connecting member 16 of the body 14 and the collar 62 or top cap 64. With this arrangement, the handle 24 is at least linearly fixed to housing 12, and the spring 30 exerts a spring force on the connecting member 16 to bias the body 14 toward extension out of the housing 12. However, the body 14 will retract into the housing 12 by applying a linear force to the handle 24 or the housing 12 in the second direction that is greater than the spring force from the spring 30.

Figure 2:
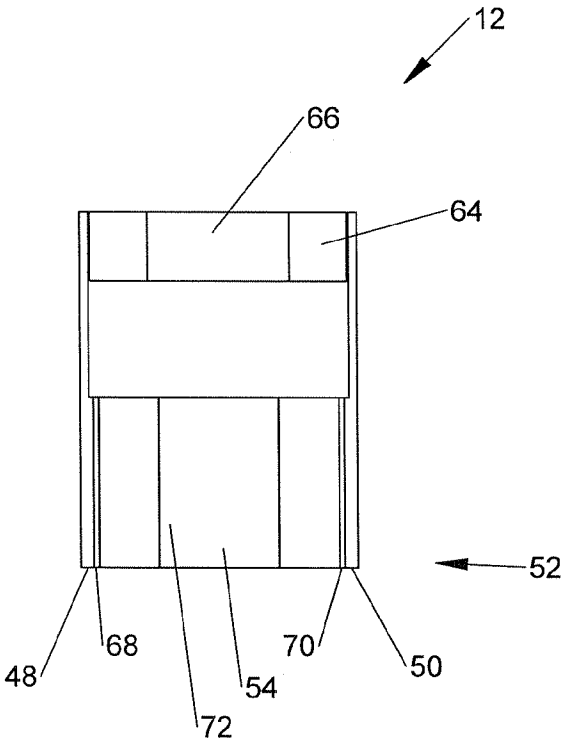
FIG. 2 is a sectional view of the housing of FIG. 1.

As best seen in FIGS. 1-2, the housing 12 includes the channels 68, 70 that extend along an inner surface 72 of the sidewall 54 for interaction with the opposed arms 18, 20 of the body 14. As used herein, the first direction is the direction in which the handle 24 primarily extends from the connecting member 16 and the second direction is the direction in which the opposed arms 18, 20 extend from the connecting member 16, unless otherwise specified.

As shown in FIGS. 1-2, the housing 12 is of a cylindrical shape, but other shapes are possible and contemplated. The top cap 64 cooperates with the at least one sidewall 54 to define a chamber for receipt of the body 14 through the first end 52 of the housing 12. Further, the aperture 66 of the top cap 64 is in registry with the collar 62. The collar 62 is annular shaped with an inner diameter to allow for passage of the handle 24 and an outer diameter to contact the aperture 66 of the top cap 64. While the top cap 64 and collar 62 are shown as different components, the top cap 64 and the collar 62 may be combined into a single object. As illustrated, the aperture 66 of the top cap 64 is a bore that extends through a thickness of the top cap 64 and the collar 62 coaxially extends with the handle 24 through the top cap 64.

The at least one sidewall 54 extends normally in the second direction from the top cap 64. While the sidewall 54 is illustrated as being of the same structure as the top cap 64, it is understood that the top cap 64 and sidewall 54 could instead be modular. As illustrated, the at least one sidewall 54 is curved. However, the sidewall 54 may be made up of multiple sides that are individually planar. Further, the sidewall 54 may taper to increase or to decrease in diameter when extending from the top cap 64.

The channels 68, 70 located in the inner surface 72 of the housing 12 extend in the first and second directions and are sized so as to allow at least a part of the body 14 to be received within the channels 68, 70. The parts of the body 14 that may be received by the channels 68, 70 are the opposed arms 18, 20 of the body 14. Alternatively, flanges may directly ride in the respective channels 68, 70, thereby eliminating the need for the opposed arms 18, 20 to ride in the channels 68, 70. Interaction between the channels 68, 70 and the opposed arms 18, 20 prevent relative rotation between the housing 12 and the body 14. Further, the channels 68, 70 function to guide the body 14 in the first and second linear directions so that the camming surfaces 48, 50 of the housing 12 can engage the cam members 36, 38. At the first end 52 of the housing 12, the camming surfaces 48, 50 are generally planar and are generally normal to the inner surface 72 of the sidewall 54. The respective camming surfaces 48, 50 are shaped so as to engage and rotate the respective cam members 36, 38, as will be discussed in more detail hereinbelow.

The opposed arms 18, 20 of the body 14 remain parallel to one another as they extend from the connecting member 16. While the body 14 is shown to have a rectangular cross-section, other shapes are possible. The handle 24 extends in the first direction from the body 14 and the opposed arms 18, 20 extend in the second direction from the connecting member 16.

As mentioned hereinabove, retraction of the body 14 into the housing 12 will result in the camming surface 48, 50 of the housing 12 turning the respective cam members 36, 38 so that the extraction ends 56, 58 of the cam members 36, 38 will begin to point towards the connecting member 16 of the body 14. It should be further noted that the handle 24 is not required for the extraction device 10 to operate. Instead, the extraction device 10 could be operated by applying the linear force to the housing 12 instead of the handle 24. As such, the handle 24 is a convenience to the operator.

With reference once again to the body 14, the opposed arms 18, 20 cooperate with the respective channels 68, 70 in the inner surface 72 of the housing 12. This cooperation limits relative motion between the housing 12 and the body 14 to the first and second directions and reduces the amount of rotation that can occur between the housing 12 and the body 14.

The opposed arms 18, 20 of the body 14 also include the slots 32, 34 for pivotal receipt of the cam members 36, 38. The slots 32, 34 extend from a terminal end of the opposed arms 18, 20 toward the connecting member 16. As best shown in FIG. 4, the slots 32, 34 in the opposed arms 18, 20 of the body 14 are large enough to rotationally accommodate the cam members 36, 38. The cam members 36, 38 are held in the respective slots 32, 34 with their respective pins 40, 42 that extends through the cam members 36, 38. However, it is envisioned that the cam members 36, 38 could be held in the slots 32, 34 with protrusions that would not fully extend through the cam members 36, 38. The slots 32, 34 allow the cam members 36, 38 to rotate about the respective pins 40, 42 as the respective cam members 36, 38 contact the respective camming surfaces 48, 50 of the housing 12.

The cam members 36, 38 each include the respective lever end 44, 46 and the respective extraction end 56, 58. As illustrated, the lever end 44, 46 of the cam members 36, 38 can be planar to encourage engagement with the camming surface 48, 50 of the housing 12. Further, the extraction end 56, 58 of the cam members 36, 38 can be pointed to aid in engagement with the fastener 60. In particular, the pointed shape of the extraction end 56, 58 of the cam members 36, 38 can be useful for getting underneath a head of the fastener 60. By using the cam members 36, 38, the operator can apply a controlled linear force to remove the fastener 60, without the risk of self injury or damage to the fastener 60 or surrounding area.

Figure 7:
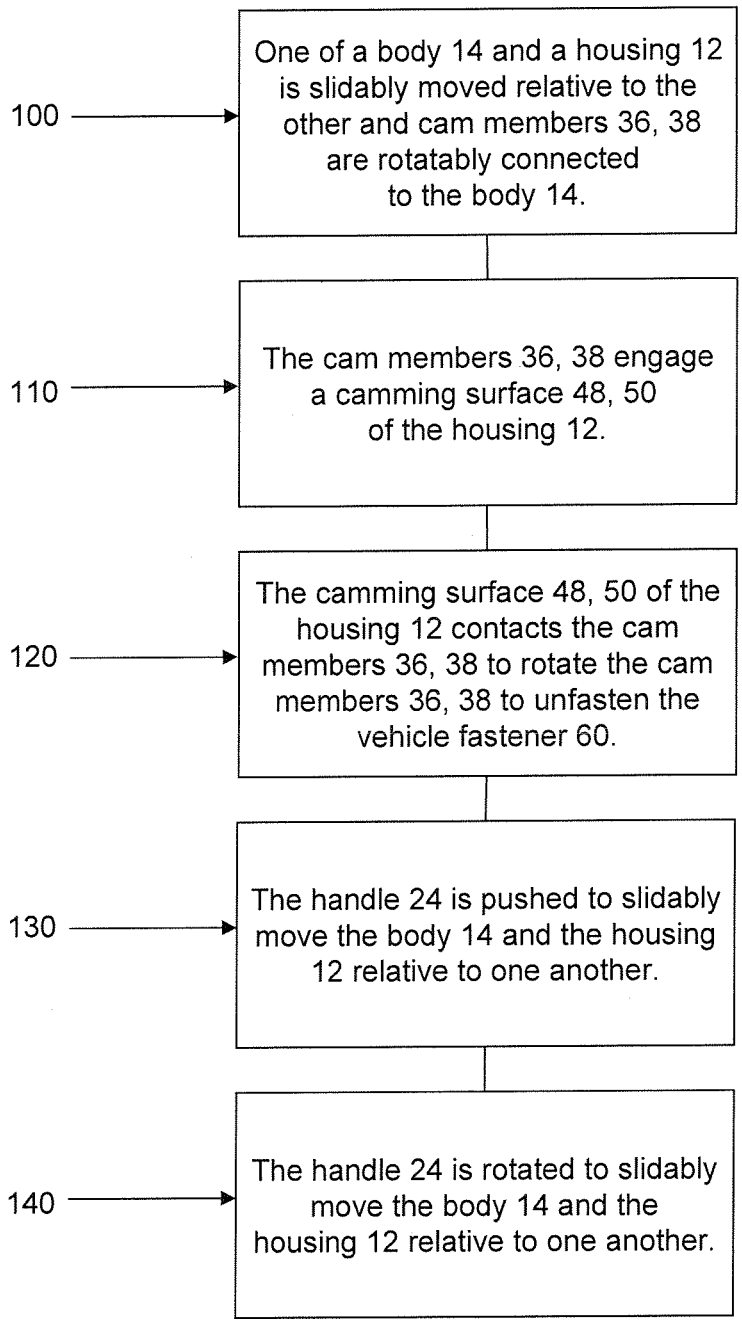
FIG. 7 is a flowchart of a method of removing the vehicle fastener.

With reference to FIG. 7, a method of removing a fastener from a vehicle will now be discussed. In 100, one of a body 14 and a housing 12 is slidably moved relative to the other and cam members 36, 38 are rotatably connected to the body 14. In 110, the cam members 36, 38 engage a camming surface 48, 50 of the housing 12. In 120, the camming surface 48, 50 of the housing 12 contacts the cam members 36, 38 to rotate the cam members 36, 38 to unfasten the vehicle fastener 60, and the body 14 and the housing 12 are slidably moved relative to one another. In 130, the handle 24 is pushed to slidably move the body 14 and the housing 12 relative to one another. In 140, the handle 24 is rotated to slidably move the body 14 and the housing 12 relative to one another.

It will be appreciated that the above-disclosed and other features and functions, or alternatives or varieties thereof, may be desirably combined into many other different systems or applications. Also presently unforeseen or unanticipated alternatives, modifications, variations or improvements therein may be subsequently made by those skilled in the art which are also intended to be encompassed by the following claims.

The invention claimed is:

1. An extraction device for removing a vehicle fastener, comprising:

a housing having a camming surface;

a body slidably connected to the housing and including opposed arms, the housing including a sidewall having an inner surface having a channel defined therein, one of the arms being slidingly received in the channel; and cam members rotatably connected to the arms of the body, wherein slidable movement of the body and the housing relative to one another causes engagement between the camming surface and the cam members, thereby causing the cam members to rotate and unfasten the vehicle fastener.

2. The extraction device for removing a vehicle fastener of claim 1, wherein the sidewall extends in a first direction and a second direction, the second direction being opposite the first direction.

3. The extraction device for removing a vehicle fastener of claim 2, further comprising:

a handle mating with the housing so that the handle and the housing are slidable together relative to the body, the handle also cooperating with the body so as to allow linear independent movement in the first and second directions between said handle and said body.

4. The extraction device for removing a vehicle fastener of claim 3, wherein the channel extends in the first and second directions along the inner surface of the sidewall.

5. The extraction device for removing a vehicle fastener of claim 4, wherein the sidewall of the housing includes opposed channels, each arm being slidingly received by one of the channels of the housing to restrict movement between the housing and the body to the first and second directions.

6. The extraction device for removing a vehicle fastener of claim 5, wherein the opposed arms each have a slot for pivotal receipt of the cam members.

7. The extraction device for removing a vehicle fastener of claim 6, wherein the opposed arms are connected by a connecting member.

8. The extraction device for removing a vehicle fastener of claim 7, further comprising:

a spring that is coaxially disposed on the handle between the connecting member and a top cap of the housing to bias the body away from the top cap.

9. The extraction device for removing a vehicle fastener of claim 3, wherein an aperture of the body is threaded so as to provide for threaded engagement with a threaded portion of the handle so that rotation of the handle causes linear movement of the body and engagement between the cam members and the camming surface of the housing.

10. An extraction device for removing a vehicle fastener, comprising:

a housing with a camming surface at a first end of the housing;

a body slidably received through the first end of the housing so that at least a portion of the body is within the housing; and cam members pivotably attached to the body, each cam member is a one-piece member that includes a lever end having a section extending laterally from the body and an extraction end, wherein the sections of the lever ends of the cam members contact the camming surface of the housing so as to rotate the respective extraction ends of the cam members to contact and unfasten the vehicle fastener.

11. The extraction device for removing a vehicle fastener of claim 10, wherein the housing includes at least one channel that extends in a linear direction along an inner surface of the housing to restrict movement of the body to the linear direction.

12. The extraction device for removing a vehicle fastener of claim 11, further comprising:

a handle mating with the housing so that the handle and the housing are slidable together relative to the body, the handle also cooperating with the body so as to allow linear independent movement between said handle and said body.

13. The extraction device for removing a vehicle fastener of claim 12, wherein the body includes opposed arms to be received by the channel of the housing to restrict movement between the housing and the body to the linear direction.

14. The extraction device for removing a vehicle fastener of claim 13, wherein the opposed arms each have a slot for pivotal receipt of the cam members and the cam members are at least partially retained in the respective slots by a respective pin.

15. The extraction device for removing a vehicle fastener of claim 14, wherein the opposed arms extend a connecting member in a generally parallel direction to form a U-shape.

16. The extraction device for removing a vehicle fastener of claim 12, wherein an aperture of the body is threaded so as to provide for threaded engagement with a threaded portion of the handle such that rotation of the handle results in linear movement of the body.

17. The extraction device for removing a vehicle fastener of claim 12, further comprising:

a spring that is annularly disposed about an engagement end of the handle to provide a spring force to the body increase a distance between the cam members and the camming surface.

18. A method of removing a fastener from a vehicle, comprising:

slidably moving one of a body and a housing relative to the other of the body and the housing, the body having opposed arms with cam members rotatably connected directly thereto, each cam member includes a lever end and an extraction end;

engaging a camming surface of the housing with the cam members; and rotating the cam members with the camming surface to unfasten the vehicle fastener when the camming surface engages the cam members, and the body and the housing are slidably moved relative to one another.

19. The method of removing a fastener from a vehicle of claim 18, further comprising:

pushing a handle that extends from the body so that the cam members contact the camming surface of the housing.

20. The method of removing a fastener from a vehicle of claim 18, further comprising:

rotating a handle that extends from the body so that the cam members contact the camming surface of the housing.

* * * * *